US007513484B1

(12) United States Patent
Selby

(10) Patent No.: US 7,513,484 B1
(45) Date of Patent: Apr. 7, 2009

(54) FOLDING HAND-OPERATED CABLE WINCH

(75) Inventor: Ricky W. Selby, Moosup, CT (US)

(73) Assignee: Keeper Corporation, North Windham, CT (US)

( * ) Notice: Subject to any disclaimer, the term of this patent is extended or adjusted under 35 U.S.C. 154(b) by 0 days.

(21) Appl. No.: 12/229,270

(22) Filed: Aug. 21, 2008

(51) Int. Cl.
*B25B 25/00* (2006.01)

(52) U.S. Cl. ..... 254/243; 74/545; 74/547; 74/551.3; 74/551.7

(58) Field of Classification Search ..... 254/218, 254/237, 243, 249; 74/528, 534, 545, 547, 74/551.3, 551.7
See application file for complete search history.

(56) References Cited

U.S. PATENT DOCUMENTS 1,870,403 A * 8/1932 Coffing ..... 81/177.2
4,531,715 A * 7/1985 Wiens ..... 254/266
5,590,673 A * 1/1997 Earnshaw ..... 135/20.1
5,878,859 A * 3/1999 Borlinghaus et al. ..... 192/90
6,508,190 B1 * 1/2003 Norton ..... 114/230.2
6,921,060 B2 * 7/2005 Weed, Jr. ..... 254/266
6,945,516 B1 * 9/2005 Scott et al. ..... 254/231
7,178,391 B2 * 2/2007 Casper et al. ..... 73/152.05
7,178,752 B1 * 2/2007 Chang ..... 242/284

* cited by examiner

*Primary Examiner*—Emmanuel M Marcelo
(74) *Attorney, Agent, or Firm*—M. P. Williams

(57) ABSTRACT

A hand-operated cable winch (10) has a proximal handle part (12) with a pawl (16) that engages a toothed gear (21) which causes rotation of a cable (23) onto a drum. A distal handle part (13) is rotatably disposed between ends (31, 32) of said proximal part by a pivot (14). A retaining sleeve (27) slides over a spring latch (28), depressing it toward the distal part (13) as it slides by it. When the distal part (13) is rotated into working alignment with the distal part (12), a retaining sleeve (27) may slide proximally, depressing a spring latch (28) and sliding over it, into a locked position, which thereafter prevents the retaining sleeve from moving so that the winch may be operated by means of the distal handle part (13). To fold the handle, the operator depresses the spring latch (28), slides the retaining sleeve (27) distally to its inoperative position on the distal part, and rotates the distal part into a folded position.

3 Claims, 4 Drawing Sheets

FOLDING HAND-OPERATED CABLE WINCH

TECHNICAL FIELD

This invention relates to a hand-operated cable winch, sometimes referred to as a "come-along", the handle of which is selectively rotated into a folded position, thereby saving space and rendering the winch easier to handle when not in use.

BACKGROUND ART

A hand-operated cable winch, sometimes referred to as a "come-along", has a handle with a pawl thereon which, when rotated in a drawing direction, will rotate a toothed gear connected to a cable winding drum, thereby to draw cable around the drum and toward the winch. In typical usage, the winch is fastened to one item, the cable is released and drawn to a distant point where it is attached to another item. One of the items may be an anchor (some immovable object) or both items might be movable. The handle is reciprocated, driving the cable winding drum, and drawing the cable toward the winch, until the desired effect is achieved.

When it is deemed appropriate, a lever on the winch can be transferred from the drawing position to a released position, and the tension in the cable can then be released by motion of the handle, or by free rotation of the cable winding drum. The cable may be wound on the drum for storage.

SUMMARY

Objects of this invention include a hand-operated cable winch which can become compact when not in use; a hand-operated cable winch which takes up less space when not in use; a hand-operated cable winch which is easy to handle when not in use; and a hand-operated cable winch which is very easily transferred between a condition in which the handle is locked into position for use, and a condition in which the handle may be rotated into a folded position.

According to the invention, the handle of a hand-operated cable winch has two parts, connected by a pivot, so that a distal part can be rotated relative to a proximal part; a sleeve is configured to slide over both the distal part and the proximal part when the handle has been rotated into the working position; the sleeve engages both parts of the handle causing the combined handle to be sufficiently rigid so that it can be utilized to rotate the cable winding drum. In further accord with the invention, the retaining sleeve, once it has fully engaged both parts, is prevented from sliding away from its engaged position by an easily released spring latch.

Other variations will become more apparent in the light of the following detailed description of exemplary embodiments, as illustrated in the accompanying drawings.

MODE(S) OF IMPLEMENTATION

Figure 1:
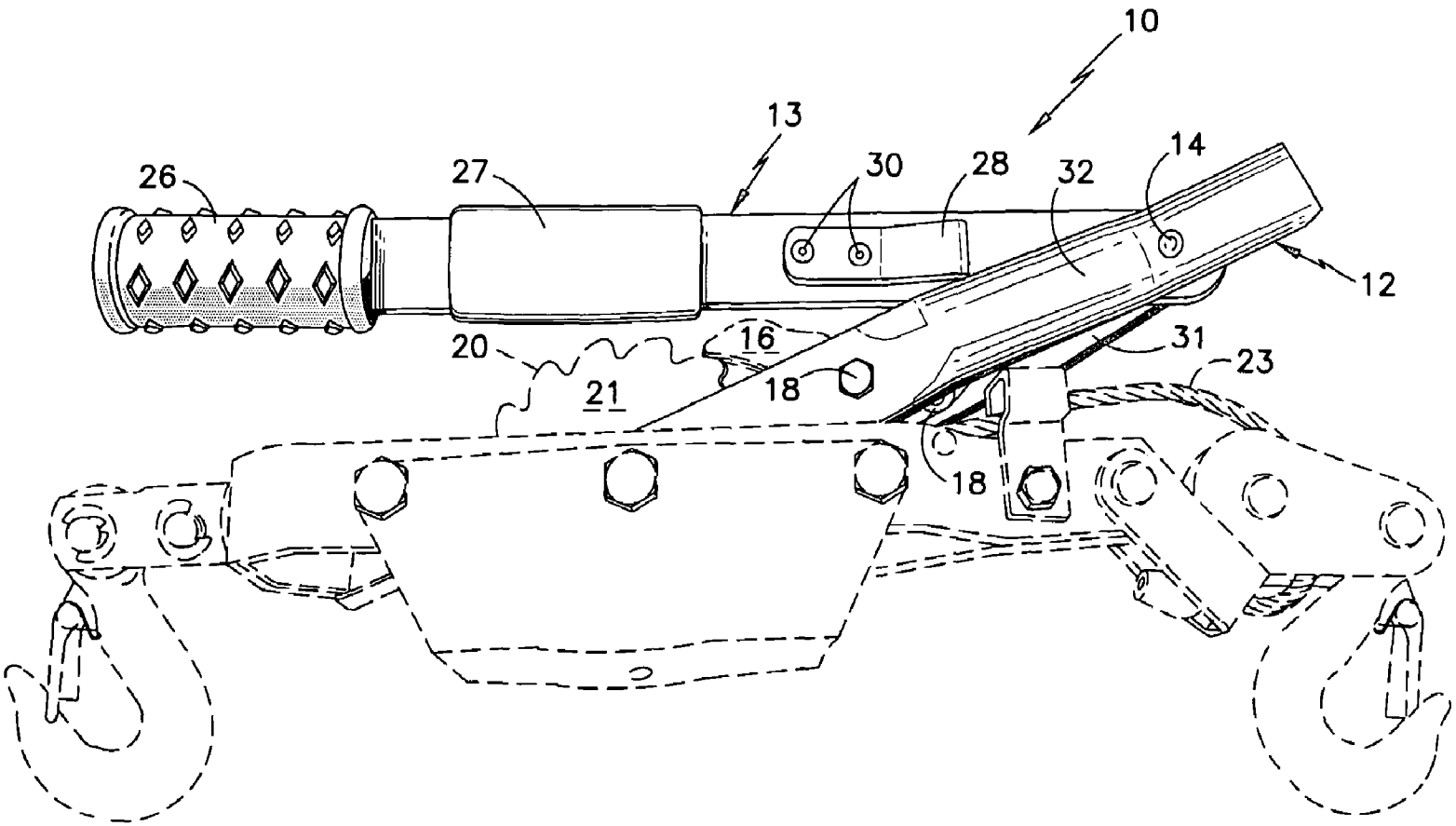
FIG. 1 is a slightly tilted, side elevation view of a hand-operated cable winch shown with the distal part of the handle in the folded position, the parts thereof not related to the folding handle of the invention being show in phantom.

Referring to FIG. 1, a hand-operated cable winch 10 (hereinafter referred to as "winch"), includes a novel handle having a proximal part 12 rotatably disposed to a distal part 13 by a fixed pivot 14. A pawl 16 is rotatably engaged to the proximal handle part 12 by a pivot 18 so that when the proximal part 12 is rotated (counterclockwise as seen in FIG. 1) the pawl 16 will engage teeth 20 on a gear 21 causing a cable drum (not shown) to draw the cable 23 toward the drum. Such operation is conventional.

The distal part 13 of the handle has a grip 26, a slidable retaining sleeve 27 and a spring latch 28 held to the distal part 13 in a suitable fashion, such as by a pair of rivets 30.

The proximal part of the handle 12 includes separated branches 31, 32 which are closed together by the pivot 14 near their outer ends, and are spread apart at their other ends to make room for the gear 21 and the drum.

Figure 2:
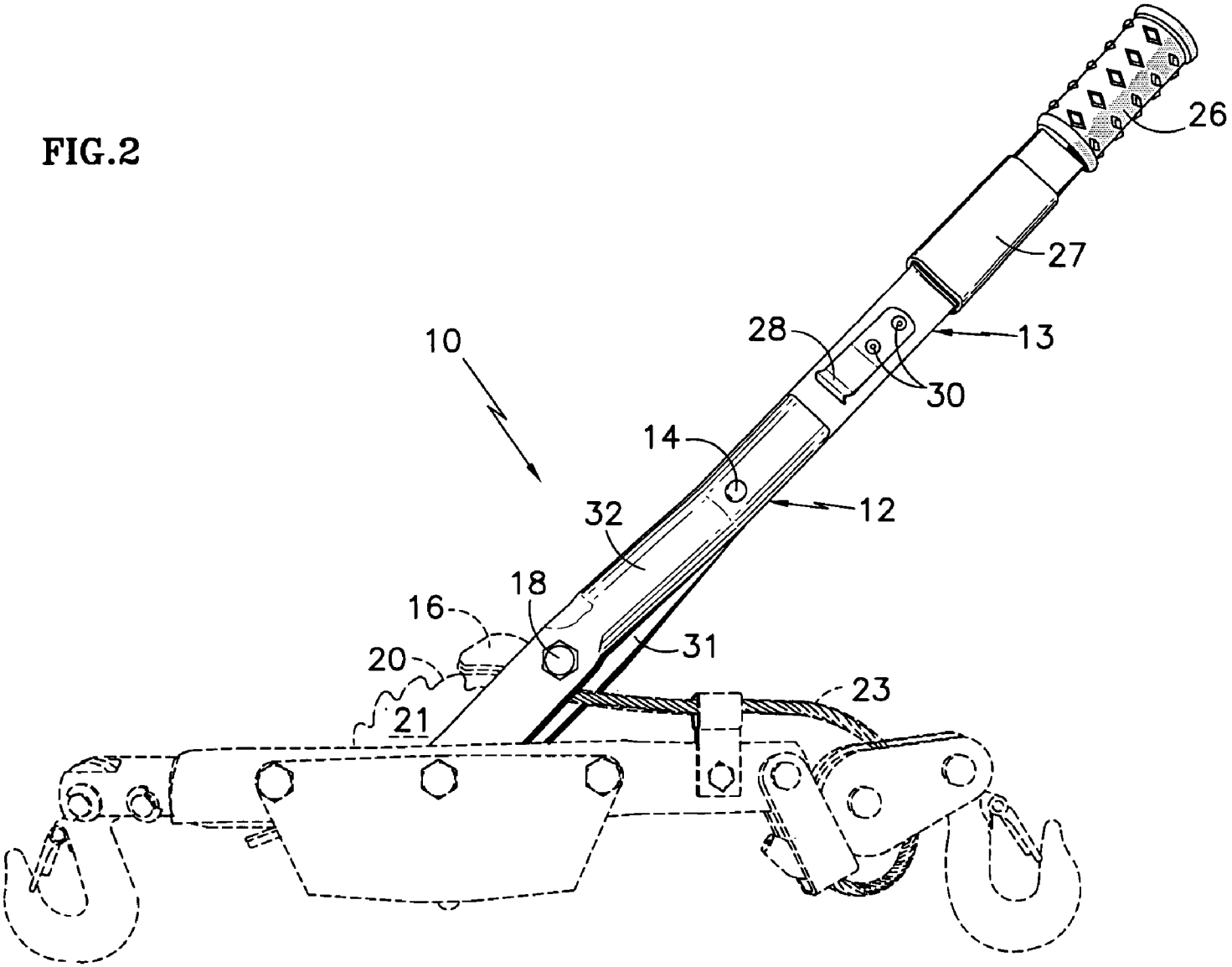
FIG. 2 is a slightly tilted, side elevation view of the hand-operated cable winch of FIG. 1, shown with the distal part of the handle rotated into the operative position, but with the retaining sleeve not yet engaged, the parts thereof not related to the folding handle of the invention being shown in phantom.

In FIG. 2, the distal part of the handle 13 has been rotated into working alignment with the proximal part 12 of the handle, but the retaining sleeve 27 remains in its inoperative position.

Figure 3:
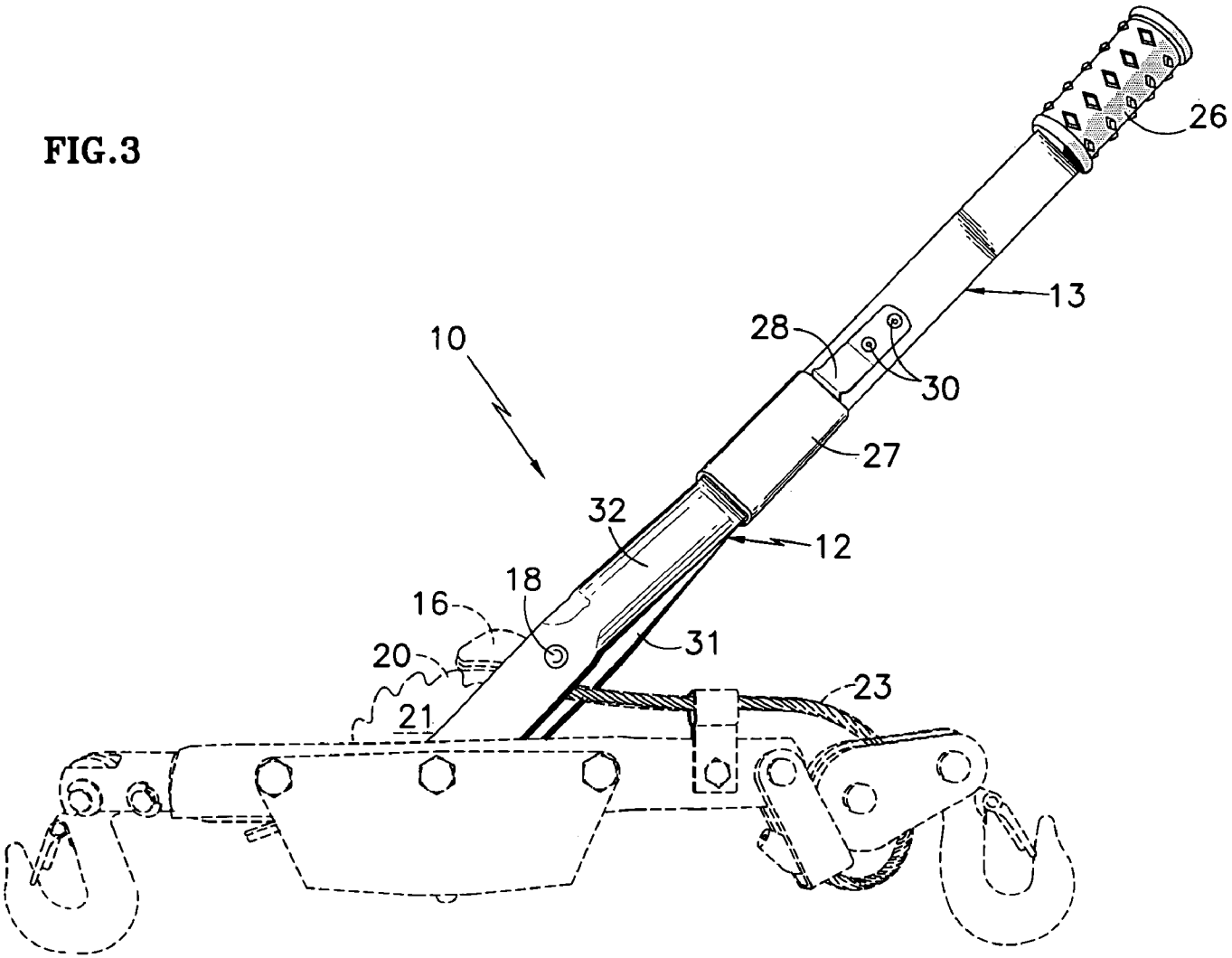
FIG. 3 is a slightly tilted, side elevation view of the hand-operated cable winch of FIG. 1, shown with the distal part of the handle rotated into the operative position, with the retaining sleeve engaging both parts of the handle and being held in the engaged position by the spring latch, the parts thereof not related to the folding handle of the invention being shown in phantom.

In FIG. 3, the retaining sleeve 27 has depressed the spring latch so as to slide over it, and is positioned over the outer ends of the branches 31, 32 of proximal part 12 so that the distal part 13 can no longer rotate with respect to the proximal part 12. The retaining sleeve 27 is now prevented from moving distally by the spring latch 28. The winch is now ready for work in the conventional fashion.

Figure 4:
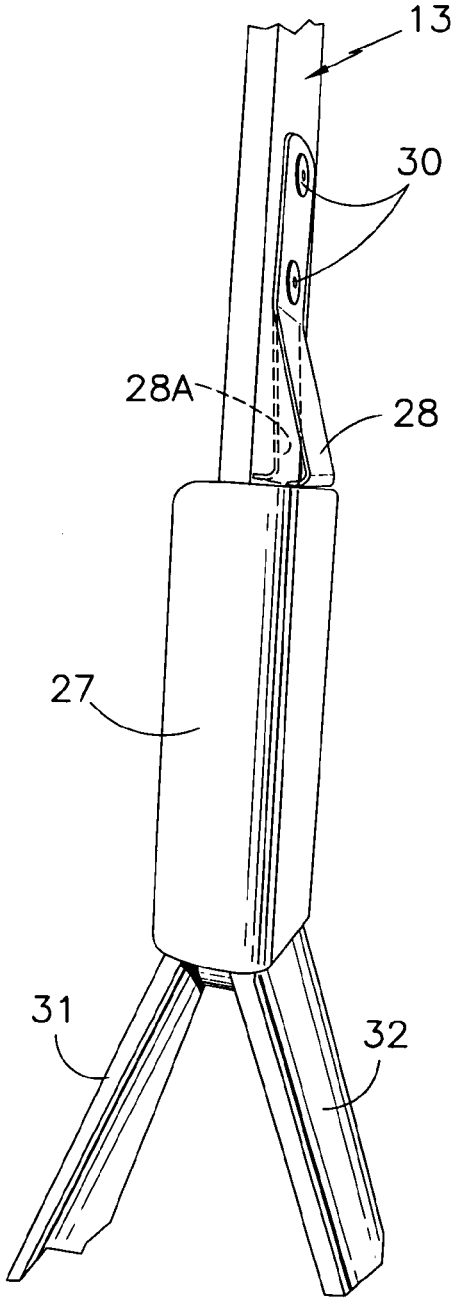
FIG. 4 is a fragmentary, partially rotated, front elevation view of the retaining sleeve engaging both the proximal part and the distal part of the handle with the sleeve being held in place by the spring latch, similar to FIG. 3.
Figure 5:
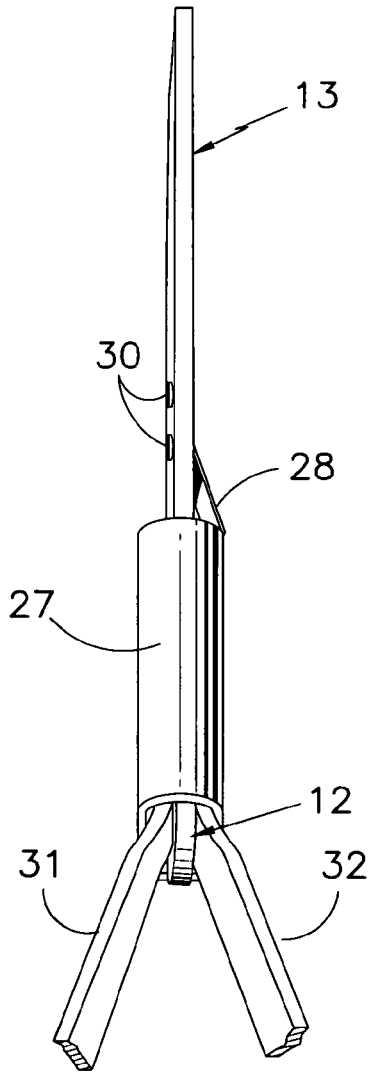
FIG. 5 is a fragmentary, partially rotated, front elevation view of the parts of the handle being held in alignment, similar to that illustrated in FIGS. 3 and 4.

The spring latch 28 is shown most clearly in FIGS. 4 and 5. For the retaining sleeve to move from the position shown in FIG. 2 to the position shown in FIG. 3, the retaining sleeve will, as it slides in a proximal direction, cause the spring latch 28 to flex into the position 28*a* shown in phantom in FIG. 4, in which the retaining sleeve can slide over the spring latch 28*a* until it is in the full proximal position as illustrated in FIGS. 3, 4 and 5. Then the spring latch 28 will spring outwardly as illustrated in FIGS. 4 and 5 to hold the retaining sleeve in the operative position.

Although the retaining sleeve 27 must have a relatively close fit to the proximal and distal parts 12, 13 in its broad dimension (that is from top to bottom as seen in FIG. 1), the sleeve can have sufficient clearance for the spring latch 28 in the other dimension (front to back as seen in FIG. 1) without allowing relative rotation between the proximal and distal parts 12, 13 when in the operative position.

When the winch no longer needs to be used, the handle may be folded by the operator stressing the spring latch 28 inwardly toward the distal part to allow the retaining sleeve to slide distally from the position shown in FIG. 3 back to the position shown in FIG. 2.

Thus, although the invention has been shown and described with respect to exemplary embodiments thereof, it should be understood by those skilled in the art that the foregoing and various other changes, omissions and additions may be made therein and thereto, without departing from the spirit and scope of the invention.

I claim:

1. A hand-operated cable winch (10) comprising:

a drum with a toothed gear (21) configured to have a cable (23) wound upon it;

a bifurcated, proximal handle part (12) comprising two pieces (31, 32), said pieces being separated at inner ends so as to straddle said toothed gear and said drum, and being bent so as to come close together at outer ends, said proximal part supporting a pawl (16) to rotate said gear;

a distal handle part (13) rotatably disposed between said outer ends by a pivot (14);

a spring latch (28) having a distal portion affixed to said distal part and a proximal portion bent outwardly from said distal part; and a retaining sleeve (27) disposed to slide from an inoperative position on said distal part, in a proximal direction when said distal part is in working alignment with said proximal part, forcing said spring latch to have its proximal portion sprung inwardly toward said distal part, in a manner configured to allow said retaining sleeve to slide over said spring latch to a position (a) substantially surrounding (i) said outer ends of said proximal part and (ii) a portion of said distal part and (b) on the proximal side of said spring latch, whereby said spring latch relaxes into a rest position where it extends outwardly from said distal part sufficiently to prevent distal motion of said retaining sleeve, thereby to lock said proximal and distal handle parts into working alignment with one another.

2. A winch (10) according to claim 1 wherein:

said retaining sleeve (27) comprises a flattened hollow cylinder.

3. A winch (10) according to claim 1 wherein:

said spring latch (28) is fixed to said distal handle part (13) by rivets (30).

* * * * *